US010180633B2

(12) United States Patent
Asakawa

(10) Patent No.: US 10,180,633 B2
(45) **Date of Patent: *Jan. 15, 2019**

(54) ELECTROSTATIC LATENT IMAGE DEVELOPING TONER

(71) Applicant: KYOCERA Document Solutions Inc., Osaka (JP)

(72) Inventor: Tomoyasu Asakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/567,301

(22) PCT Filed: Dec. 28, 2016

(86) PCT No.: PCT/JP2016/089049

§ 371 (c)(1),
(2) Date: Oct. 17, 2017

(87) PCT Pub. No.: WO2017/141554

PCT Pub. Date: Aug. 24, 2017

(65) Prior Publication Data

US 2018/0095375 A1 Apr. 5, 2018

(30) Foreign Application Priority Data

Feb. 18, 2016 (JP) ..... 2016-028846

(51) Int. Cl.

| | |
|---|---|
| ***G03G 9/08*** | (2006.01) |
| ***G03G 9/093*** | (2006.01) |
| ***G03G 9/087*** | (2006.01) |

(52) U.S. Cl.
CPC ..... *G03G 9/09321* (2013.01); *G03G 9/08* (2013.01); *G03G 9/087* (2013.01); *G03G 9/093* (2013.01);
(Continued)

(58) Field of Classification Search
CPC . G03G 9/093; G03G 9/09307; G03G 9/09321
(Continued)

(56) References Cited

U.S. PATENT DOCUMENTS 9,594,324 B2 * 3/2017 Tamagaki ..... G03G 9/0821

FOREIGN PATENT DOCUMENTS

JP 2001-201891 A 7/2001

* cited by examiner

*Primary Examiner* — Mark A Chapman
(74) *Attorney, Agent, or Firm* — Studebaker & Brackett PC

(57) ABSTRACT

An electrostatic latent image developing toner includes a plurality of toner particles each including a toner mother particle and inorganic particles attached to a surface of the toner mother particle. The toner mother particle includes a toner core (11) and a shell layer (12) covering a surface of the toner core (11). The shell layer (12) includes film-shaped first domains (12*a*) and particle-shaped second domains (12*b*). The first domains (12*a*) are substantially formed from a non-cross-linked resin. The second domains (12*b*) are substantially formed from a cross-linked resin. The cross-linked resin has a glass transition point higher by 40° C. or more than that of the non-cross-linked resin. The first domains (12*a*) have a surface adsorption force of at least 20.0 nN and no greater than 40.0 nN. The second domains (12*b*) have a surface adsorption force of at least 4.0 nN and less than 20.0 nN.

10 Claims, 4 Drawing Sheets

(52) U.S. Cl.
CPC ..... *G03G 9/09307* (2013.01); *G03G 9/09371* (2013.01)

(58) Field of Classification Search
USPC ..... 430/110.2
See application file for complete search history.

ELECTROSTATIC LATENT IMAGE DEVELOPING TONER

TECHNICAL FIELD

The present invention relates to an electrostatic latent image developing toner.

BACKGROUND ART

Toner particles included in a capsule toner each include a core and a shell layer (capsule layer) disposed over a surface of the core (see for example Patent Literature 1). In a toner production method disclosed in Patent Literature 1, the cores (toner core material) and two types of resin fine particles having different glass transition points (glass transition temperature) are mixed together to form the shell layer on the surface of the core.

CITATION LIST

Patent Literature

[Patent Literature] Japanese Patent Application Laid-Open Publication No. 2001-201891

SUMMARY OF INVENTION

Technical Problem

However, it is difficult to provide an electrostatic latent image developing toner excellent in heat-resistant preservability, low-temperature fixability, and external additive hodling ability only by the technique disclosed in Patent Literature 1.

The present invention has been made in view of the foregoing and has its object of providing an electrostatic latent image developing toner excellent in heat-resistant preservability, low-temperature fixability, and external additive hodling ability.

Solution to Problem

An electrostatic latent image developing toner according to the present invention includes a plurality of toner particles each including a toner mother particle and inorganic particles attached to a surface of the toner mother particle. The toner mother particle includes a core and a shell layer covering a surface of the core. The shell layer includes film-shaped first domains and particle-shaped second domains. The first domains are substantially formed from a non-cross-linked resin. The second domains are substantially formed from a cross-linked resin. The cross-linked resin has a glass transition point higher by 40° C. or more than that of the non-cross-linked resin. The first domains have a surface adsorption force of at least 20.0 nN and no greater than 40.0 nN. The second domain has a surface adsorption force of at least 4.0 nN and less than 20.0 nN.

Advantageous Effects of Invention

According to the present invention, an electrostatic latent image developing toner excellent in heat-resistant preservability, low-temperature fixability, and external additive hodling ability can be provided.

DESCRIPTION OF EMBODIMENTS

Figure 1:
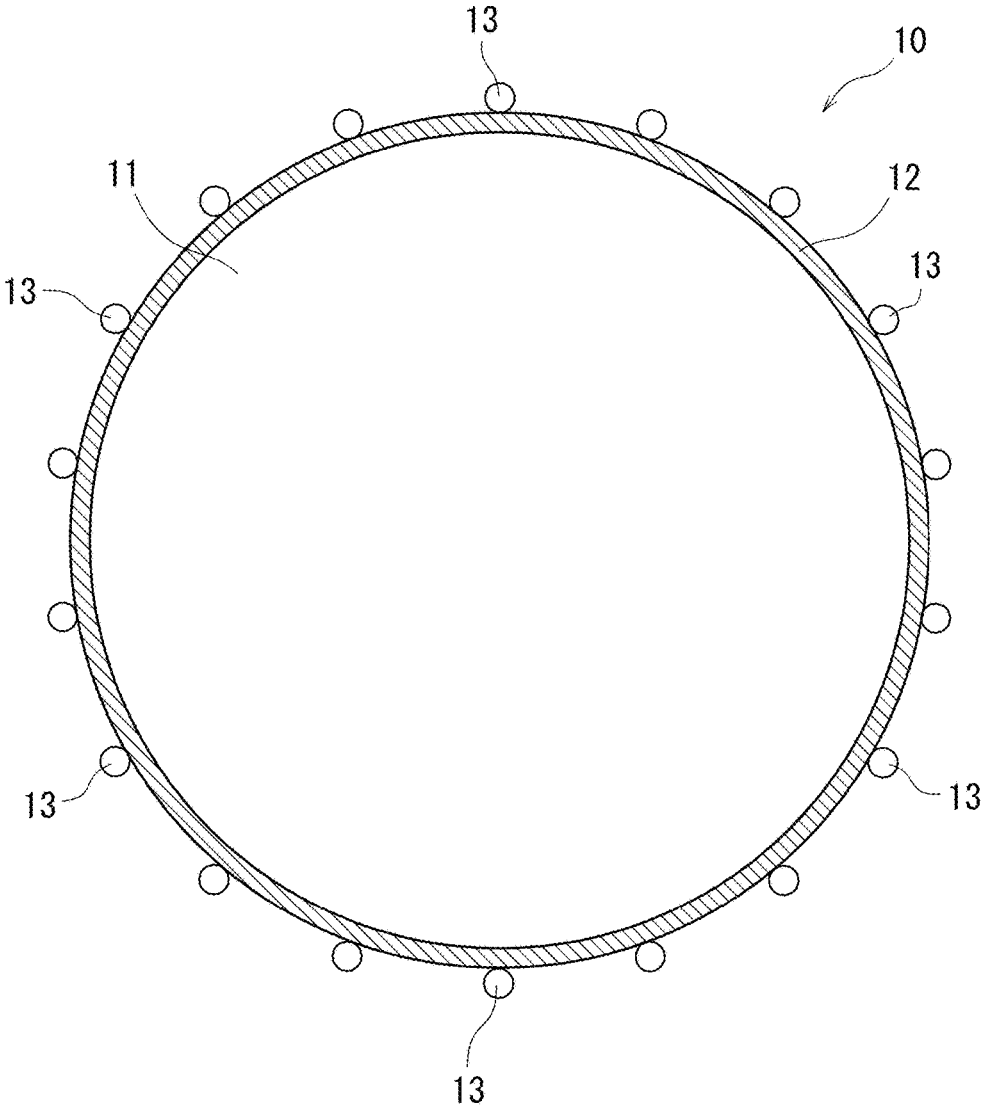
FIG. 1 illustrates an example of a sectional structure of a toner particle included in an electrostatic latent image developing toner according to an embodiment of the present invention.

The following describes an embodiment of the present invention in detail. Unless otherwise stated, evaluation results (for example, values indicating shape or physical properties) for a powder (specific examples include toner cores, toner mother particles, external additive, and toner) are number averages of values measured for a suitable number of average particles selected from the powder.

Unless otherwise stated, the number average particle diameter of a powder is a number average value of equivalent circular diameters of primary particles (diameters of circles having the same area as projected areas of the respective particles) measured using a microscope. Unless otherwise stated, a measurement value of the volume median diameter ($D_{50}$) of a powder is a value measured using a laser diffraction/scattering particle diameter distribution analyzer ("LA-750" produced by Horiba, Ltd.). Respective measurement values of an acid value and a hydroxyl value are values measured in accordance with Japan Industrial Standard (JIS) K0070-1992, unless otherwise stated. Yet, respective measurement values of a number average molecular weight (Mn) and a mass average molecular weight (Mw) are values measured by gel permeation chromatography, unless otherwise stated.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl.

In the present description, "silica particles" refer to both non-treated silica particles (also referred to below as a silica base) and silica particles (surface-treated silica particles) that are the silica base subjected to surface treatment. Furthermore, silica particles hydrophobized with a surface preparation agent may be referred to below as hydrophobic silica particles and silica particles to which positive chargeability is imparted with use of a surface preparation agent may be referred to below as positively chargeable silica particles.

A toner according to the present embodiment can be favorably used for example as a positively chargeable toner for development of an electrostatic latent image. The toner according to the present embodiment is a powder including a plurality of toner particles (each are a particle having features described later). The toner may be used as a one-component developer. Alternatively, a two-component developer may be prepared by mixing the toner with a carrier using a mixer (specific examples include a ball mill). In order that a high-quality image is formed, a ferrite carrier (powder of ferrite particles) is preferably used as the carrier. It is preferable to use magnetic carrier particles each including a carrier core and a resin layer covering the carrier core in order that high-quality images are formed for a long period of term. Carrier cores may be formed from a magnetic material (for example, ferrite) or a resin in which magnetic particles are dispersed in order to impart magnetism to the carrier particles. Alternatively, the magnetic particles may be dispersed in a resin layer covering the carrier core. In order that a high-quality image is formed, the amount of the toner in the two-component developer is preferably at least 5 parts by mass and no greater than 15 parts by mass relative to 100 parts by mass of the carrier. Note that the positively chargeable toner contained in the two-component developer is positively charged by friction with the carrier.

The toner particles included in the toner according to the present embodiment each include a toner mother particle, an external additive (specifically, inorganic particles) attached to a surface of the toner mother particle. The toner mother particle includes a core (also referred to below as a toner core) and a shell layer (capsule layer) disposed over a surface of the toner core. The toner core contains a binder resin. Further, the toner core may optionally contain an internal additive (for example, at least one of a colorant, a releasing agent, a charge control agent, and a magnetic powder). A material for forming the shell layer is referred below to as a shell material.

The toner according to the present embodiment can be used for example for image formation using an electrophotographic apparatus (image forming apparatus). Following describes an example of an image forming method using an electrophotographic apparatus.

First, an image forming section (for example, a charger and an exposure device) of the electrophotographic apparatus forms an electrostatic latent image on a photosensitive member (for example, a surface layer portion of a photosensitive drum) based on image data. Subsequently, a developing device (specifically, a developing device loaded with developer containing toner) of the electrophotographic apparatus supplies the toner to the photosensitive member to develop the electrostatic latent image formed on the photosensitive member. The toner is charged by friction with a carrier, a developing sleeve, or a blade in the developing device before being supplied to the photosensitive member. For example, the positively chargeable toner is charged positively. In a developing process, toner (specifically, charged toner) on a developing sleeve (for example, a surface layer portion of a development roller in the developing device) disposed in the vicinity of the photosensitive member is supplied to the photosensitive member to be attached to the electrostatic latent image on the photosensitive member, thereby forming a toner image on the photosensitive member. The developing device is replenished with toner for replenishment use from a toner container in compensation for consumed toner.

In a subsequent transfer process, a transfer device of the electrophotographic apparatus transfers the toner image on the photosensitive member to an intermediate transfer member (for example, a transfer belt) and further transfers the toner image on the intermediate transfer member to a recording medium (for example, paper). Thereafter, a fixing device (fixing method: nip fixing using a heating roller and a pressure roller) of the electrophotographic apparatus applies heat and pressure to the toner to fix the toner to the recording medium. Through the above processes, an image is formed on the recording medium. A full-color image can be obtained by superimposing toner images formed using different colors, such as black, yellow, magenta, and cyan. Note that the transfer process may be a direct transfer process by which a toner image on the photosensitive member is transferred directly to the recording medium not via the intermediate transfer member. A belt fixing method may be adopted as a fixing method.

The toner according to the present embodiment is an electrostatic latent image developing toner having the following features (also referred to below as basic features).

(Basic Features of Toner)

The electrostatic latent image developing toner includes a plurality of toner particles each including a toner mother particle and inorganic particles (external additive). The toner mother particle includes a toner core and a shell layer. The shell layer includes film-shaped first domains and particle-shaped second domains. The first domains are substantially formed from a non-cross-linked resin. The second domains are substantially formed from a cross-linked resin. The cross-linked resin has a glass transition point (Tg) higher by 40° C. or more than that of the non-cross-linked resin. The first domains have a surface adsorption force (also referred to below as a first surface adsorption force) of at least 20.0 nN and no greater than 40.0 nN. The second domains have a surface adsorption force (also referred to below as a second surface adsorption force) of at least 4.0 nN and less than 20.0 nN. The first domains may each have a film shape with or without granular appearance. A surface adsorption force measuring method is the same as that in Examples described later or an alternative method thereof.

The toner having the above features is excellent in heat-resistant preservability, low-temperature fixability, and external additive hodling ability. The following describes operation and advantages of the above basic features in detail.

For example, heat-resistant preservability of the toner can be improved by covering the toner core with a resin film. Resin particles can be used as a material for forming the resin film. The resin film can be formed by melting and curing the resin particles into a film shape. By forming resin film pieces on the surface of the toner core using non-cross-linked resin particles having a low glass transition point (Tg), a wide area of the surface of the toner core can be covered with thin resin film pieces (film pieces of low-Tg non-cross-linked resin). However, the non-cross-linked resin film pieces formed as above tend to show significant variation in thickness. Such irregularity in thickness is thought to be caused by agglomeration of the resin particles. When an area ratio of a region of a surface region of the toner core where the toner core is exposed between (not covered with) the resin film pieces (region not covered with the resin film pieces) is increased, heat-resistant preservability of the toner tends to be impaired. By contrast, when the thickness of the resin film pieces is increased in the entire region thereof so that the surface of the toner core is fully covered with the resin film pieces, low-temperature fixability of the toner tends to be impaired.

The present inventor has found that when the surface of the toner core is incompletely covered (at a low coverage ratio) with non-cross-linked resin film pieces and interstices among the film pieces is filled with cross-linked resin particles, an even shell layer can be formed (eventually, sufficient heat-resistant preservability of the toner can be ensured). The shell layer of the toner having the aforementioned basic features includes the film-shaped first domains and the particle-shaped second domains. The first domains are substantially formed from a non-cross-linked resin. The second domains are substantially formed from a cross-linked resin. Further, the cross-linked resin has a glass transition point (Tg) higher by 40° C. or more than that of the non-cross-linked resin. When the toner core is covered with the first domains (low-Tg non-cross-linked resin film pieces) and the second domains (high-Tg cross-linked resin particles), both heat-resistant preservability and low-temperature fixability can be imparted to the toner. When the second domains are present in a region of the surface region of the toner core where the toner core is exposed between (not covered with) the first domains, the first domains can have comparatively thin film thickness. As a result, heat-resistant preservability of the toner can be improved while low-temperature fixability of the toner can be ensured. The first domains have an average height from the surface of the toner core of at least 10 nm and less than 50 nm in order to ensure sufficient low-temperature fixability of the toner.

The first domains preferably have a surface adsorption force (first surface adsorption force) of at least 20.0 nN and no greater than 40.0 nN in order that the toner has both heat-resistant preservability and external additive hodling ability. When the first surface adsorption force is excessively large, toner particles tend to agglomerate together with a result that heat-resistant preservability of the toner tends to be insufficient. Also, when the first surface adsorption force is excessively large, filming resistance of the toner tends to be impaired. By contrast, when the first surface adsorption force is excessively small, external additive hodling ability of the toner tends to be insufficient.

The second domains preferably have a surface adsorption force (second surface adsorption force) of at least 4.0 nN and less than 20.0 nN in order to ensure sufficient heat-resistant preservability of the toner and inhibit desorption of the shell layers (particularly, the second domains). When the second surface adsorption force is excessively large, the toner particles tend to agglomerate together, with a result that heat-resistant preservability of the toner tends to be insufficient. Also, when the second surface adsorption force is excessively large, filming resistance of the toner tends to be impaired. By contrast, when the second surface adsorption force is excessively small, bonding strength between the toner core and the second domains is insufficient, which eventually tends to cause desorption of the second domains from the surface of the toner core.

In order that the toner has both heat-resistant preservability and external additive hodling ability, a difference obtained by subtracting the second surface adsorption force from the first surface adsorption force (=(first surface adsorption force)−(second surface adsorption force)) is preferably at least +15 nN and no greater than +35 nN. The first and second surface adsorption forces can be adjusted by changing the types of respective monomers of the first and second domains or a ratio between the monomers.

The cross-linked resin has a Tg higher by 40° C. or more than that of the non-cross-linked resin in the above basic features. The second domains having a comparatively high Tg are thought to contribute to improvement of heat resistance of the toner particles. In order to form high-quality shell layers, a difference obtained by subtracting Tg of the non-cross-linked resin from Tg of the cross-linked resin (=(Tg of cross-linked resin)−(Tg of non-cross-linked resin)) is preferably at least +40° C. and no greater than +80° C. The respective glass transition points (Tg) of the cross-linked resin and the non-cross-linked resin can be adjusted for example by changing the types or amounts (blending ratio) of the components (monomers) of the respective resins.

The second domains are substantially formed from the cross-linked resin in the above basic features. In the above configuration, the second domains are through to form into hard particles that function as spacers among the toner particles. In order to allow the second domains to function as spacers, the second domains preferably have an average particle diameter larger than the average height of the first domains.

Preferably, the toner particle has a layered structure in which a first domain (film-shaped domain) and a second domain (particle-shaped domain) are layered in the stated order from a side of the toner core in the above basic feature in order that the toner has both heat-resistant preservability and low-temperature fixability. Specifically, the shell layer includes parts constituted by only the respective first domains (also referred to below as first shell parts), parts constituted by only the respective second domains (also referred to below as second shell parts), and parts in which a first domain and a second domain are layered in the stated order from the side of the toner core (also referred to below as third shell parts), and does not include a part in which a second domain and a first domain are layered in the stated order from the side of the toner core. For example, the layered structure (lower layer: first domain, upper layer: second domain) can be formed in a manner that a low-Tg non-cross-linked resin (or precursor thereof) is attached to the surface of the toner core and a high-Tg cross-linked resin particles are then attached to the surface of the toner core in a shell layer formation process. It is thought that in a situation in which the first and second domains are formed simultaneously, the low-Tg non-cross-linked resin is partly formed on the high-Tg cross-linked resin particles while the non-cross-linked resin tends to be attached to the toner cores with priority to the cross-linked resin. In a configuration in which a region in which the cross-linked resin particles and a non-cross-linked resin film piece are layered in the stated order occupies excessively large in the surface region of the toner core, low-temperature fixability of the toner is thought to be impaired.

The first domains (film-shaped domains) and the second domains (particle-shaped domains) preferably have the same polarity in order that the toner has both heat-resistant preservability and low-temperature fixability. The second domains tend to be arranged in interstices among the first domains through electric repulsion between the first and second domains. Furthermore, in order to strengthen bonding between the toner core and the shell layer the first and second domains each preferably have a polarity (for example, cationic polarity) opposite to that of the toner core (for example, anionic polarity).

The toner core preferably has a glass transition point lower than that of the non-cross-linked resin of the first domains in the above basic feature in order to improve low-temperature fixability of the toner. The toner core preferably has a glass transition point (Tg) of at least 20° C. and no greater than 55° C. in order to improve fixability of the toner in high speed fixing.

The toner core preferably contains a crystalline polyester resin and a non-crystalline polyester resin in order that the toner core has an appropriately low glass transition point.

Preferable examples of the crystalline polyester resin include polymers of monomers (resin raw materials) including at least one α,ω-alkanediol having a carbon number of at least 2 and no greater than 8 (for example, two α,ω-alkanediols of 1,4-butanediol having a carbon number of 4 and 1,6-hexanediol having a carbon number of 6), at least one α,ω-alkanedicarboxylic acid having a carbon number (including two carbon atoms of the carboxyl group) of at least 4 and no greater than 10 (for example, succinic acid having a carbon number of 4), at least one styrene-based monomer (for example, styrene), and at least one acrylic acid-based monomer (for example, acrylic acid).

The toner core preferably contains a crystalline polyester resin having a crystallinity index of at least 0.90 and no greater than 1.20 in order to impart appropriate sharp meltability to the toner core. The crystallinity index of a resin corresponds to a ratio (=Tm/Mp) of the softening point (Tm) of the resin relative to the melting point (Mp) of the resin. Definite Mp measurement cannot be done for non-crystalline resins in many cases. The crystallinity index of a crystalline polyester resin can be adjusted by changing the types or amounts (blending ratio) of materials for synthesis of the crystalline polyester resin. The toner core may contain only one crystalline polyester resin or two or more crystalline polyester resins.

In order that the toner has both heat-resistant preservability and low-temperature fixability, the toner core preferably contains a plurality of non-crystalline polyester resins having different softening points (Tm) and particularly preferably contains a non-crystalline polyester resin having a softening point of no greater than 90° C., a non-crystalline polyester resin having a softening point of at least 100° C. and no greater than 120° C., and a non-crystalline polyester resin having a softening point of at least 125° C.

Preferable examples of the non-crystalline polyester resin having a softening point of no greater than 90° C. include non-crystalline polyester resins each containing a bisphenol (for example, bisphenol A ethylene oxide adduct and/or bisphenol A propylene oxide adduct) that is an alcohol component and an aromatic dicarboxylic acid (for example, terephthalic acid) and an unsaturated dicarboxylic acid (for example, fumaric acid) that each are an acid component.

Preferable examples of the non-crystalline polyester resin having a softening point of at least 100° C. and no greater than 120° C. include non-crystalline polyester resins each containing a bisphenol (for example, bisphenol A ethylene oxide adduct and/or bisphenol A propylene oxide adduct) that is an alcohol component and an aromatic dicarboxylic acid (for example, terephthalic acid) that is an acid component and each containing no unsaturated dicarboxylic acid.

Preferable examples of the non-crystalline polyester resin having a softening point of at least 125° C. include non-crystalline polyester resins each containing a bisphenol (for example, bisphenol A ethylene oxide adduct and/or bisphenol A propylene oxide adduct) that is an alcohol component and a dicarboxylic acid having an alkyl group having a carbon number of at least 10 and no greater than 20 (for example, dodecylsuccinic acid having an alkyl group having a carbon number of 12), an unsaturated dicarboxylic acid (for example, fumaric acid), and a tri-basic carboxylic acid (for example, trimellitic acid) that each are an acid component.

Toner cores are typically categorized into pulverized cores (also called a pulverized toner) and polymerized cores (also called a chemical toner). Toner cores produced by a pulverization method belong to the pulverized cores, and toner cores produced by an aggregation method belong to the polymerized cores. Preferably, the toner core is a pulverized core containing a polyester resin in the toner having the above basic features.

Figure 2:
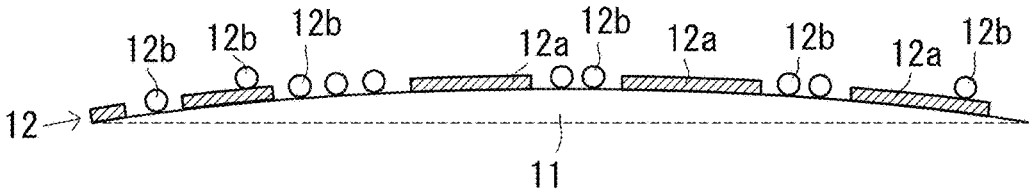
FIG. 2 is an enlarged view of a part of a surface of a toner mother particle illustrated in FIG. 1.

Following describes an example of configuration of the toner according to the present embodiment with reference to FIGS. 1 and 2. FIG. 1 illustrates an example of a configuration of the toner particle included in the toner according to the present embodiment. FIG. 2 is an enlarged view of a part of the toner mother particle illustrated in FIG. 1. FIG. 2 illustrates only the toner mother particle from which an external additive is omitted.

A toner particle 10 illustrated in FIG. 1 includes a toner mother particle and inorganic particles 13 (external additive) attached to the surface of the toner mother particle. The toner mother particle includes a toner core 11 and a shell layer 12 disposed over the surface of the toner core 11. The shell layer 12 covers the surface of the toner core 11.

As illustrated in FIG. 2, the shell layer 12 of the toner particle 10 includes film-shaped first domains 12*a* and particle-shaped second domains 12*b*. In the example illustrated in FIG. 2, some of the second domains 12*b* are present in a region of the surface of the toner core 11 that is exposed between the first domains 12*a*. The other of the second domains 12*b* present on some of the first domains 12*a*. The shell layer 12 includes the first shell parts (parts each constituted by only a first domain 12*a*), the second shell parts (parts each constituted by only a second domain 12*b*), and the third shell parts (part each in which a first domain 12*a* and a second domain 12*b* are layered in the stated order from the side of the toner core 11). However, the shell layer 12 does not include a part in which a second domain 12*b* and a first domain 12*a* are layered in the stated order from the side of the toner core 11.

The surface region of the toner core 11 includes regions each covered with a first shell part (also referred to below as first covered regions), regions each covered with a second shell part (also referred to below as second covered regions), and regions each covered with a third shell part (also referred to below as third covered regions). The first, second, and third covered regions each can be confirmed by a cross-sectional image captured of the toner particle 10. The larger the length (specifically, total length) of the covered regions measured based on a cross-sectional image of the toner particle 10 is, the larger the area (specifically, total area) of the covered regions tends to be. The total length of the second covered regions is preferably larger than that of the third covered regions in the cross-sectional image of the toner particle 10 in order to that the toner has both heat-resistant preservability and low-temperature fixability. It is thought that an excessively large total length (i.e., the area of the third covered regions) of the third covered regions (regions each covered with both the first and second domains 12*a* and 12*b*) leads to difficulty in fixing the toner at low temperature. It is thought that an excessively small total length of the second covered regions (i.e., area of the second covered regions) leads to unsatisfactory advantage by the second domains 12*b* that is improvement of heat-resistant preservability.

The first and second domains 12*a* and 12*b* each can be confirmed by observation of the surface of the toner particle 10 using a scanning probe microscope (SPM) or a transmission electron microscope (TEM).

Figure 3:
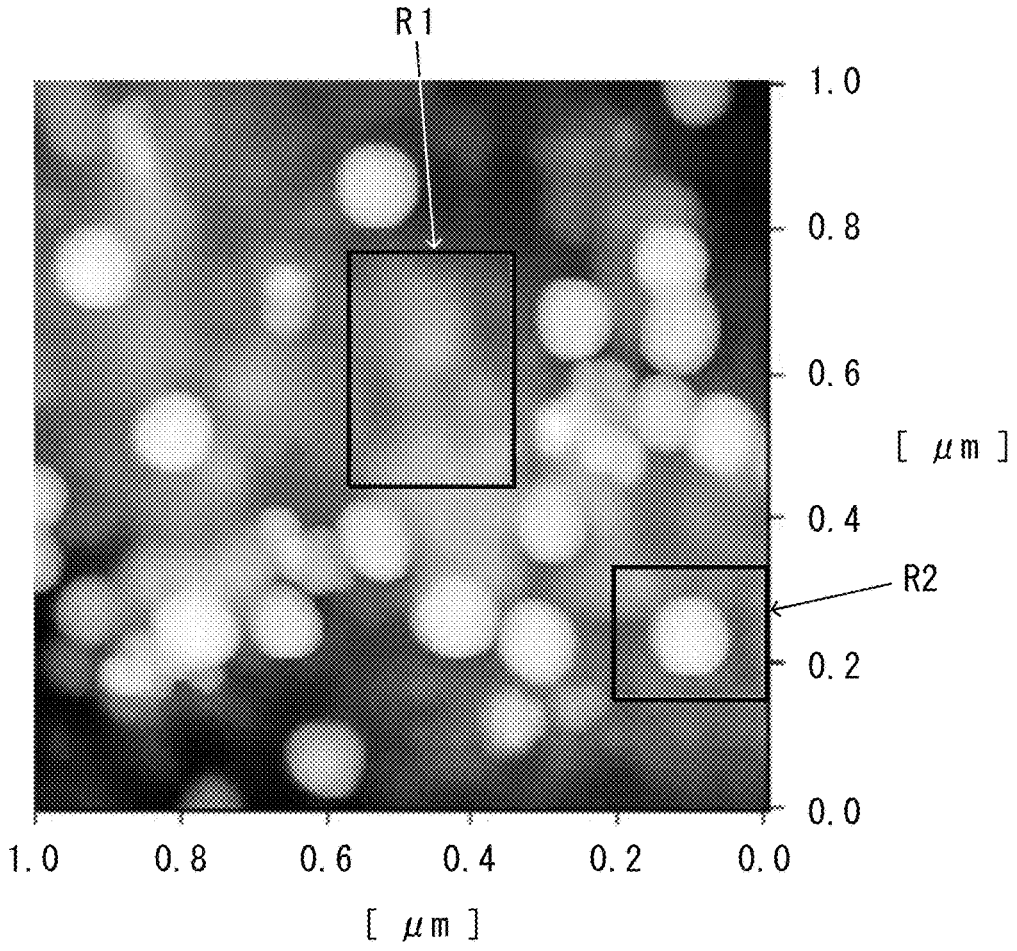
FIG. 3 is a photograph of a surface of a toner mother particle of the toner according to the embodiment of the present invention that is captured using a scanning probe microscope (SPM).
Figure 4:
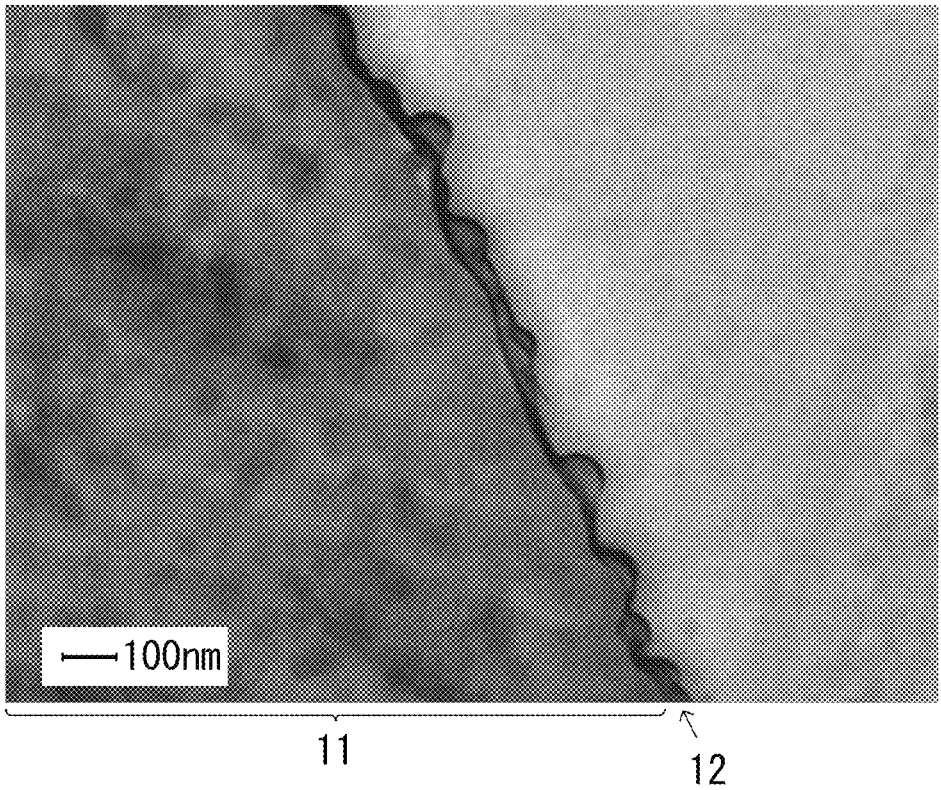
FIG. 4 is a photograph of a cross-section of a toner mother particle (particularly, a cross-section of a shell layer) of the toner according to the embodiment of the present invention that is captured using a transmission electron microscope (TEM).

FIG. 3 is a photograph of the surface of a toner mother particle of the toner according to the present embodiment captured using a SPM. For example, a resin film piece (film-shaped first domain 12*a*) can be observed in a region R1 in FIG. 3. Also, a resin particle (particle-shaped second domain 12*b*) can be observed in a region R2 in FIG. 3. FIG. 4 is a photograph of a cross section of a toner mother particle (particularly, cross section of shell layer 12) of the toner according to the present embodiment captured using a TEM. It can be confirmed from the photograph of FIG. 4 that the shell layer 12 has projections and recesses (specifically, projections and recesses respectively corresponding to first and second domains 12*a* and 12*b*).

A ratio (also referred to below as a first coverage ratio) of the total length of regions that are covered with either first or third shell parts (=total length of first and third covered regions) among the entire surface region of the toner core is preferably at least 40% and no greater than 80% relative to the peripheral length of the toner core in order that the toner has both heat-resistant preservability and low-temperature fixability. The first coverage ratio (unit: %) is expressed by an expression "(first coverage ratio)=100×((total length of first covered regions)+(total length of third covered regions))/(peripheral length of toner core)". It is thought that when the first domains are excessively thick, the first coverage ratio is so high to impair low-temperature fixability of the toner. By contrast, when the first coverage ratio is excessively low, many second domains are necessary for ensuring heat-resistant preservability of the toner, which makes it difficult to impart both heat-resistant preservability and low-temperature fixability to the toner.

A ratio (also referred to below as a second coverage ratio) of the total length of regions that are covered with any one of the first, second, and third shell parts (=total length of the first, second, and third covered regions) among the entire surface region of the toner core is preferably at least 70% and no greater than 99% relative to the peripheral length of the toner core in order that the toner has both heat-resistant preservability and low-temperature fixability. The second coverage ratio (unit: %) is expressed by an expression "(second coverage ratio)=100×((total length of first covered regions)+(total length of second covered regions)+(total length of third covered regions))/(peripheral length of toner core)".

The toner preferably has a volume median diameter ($D_{50}$) of at least 4 μm and less than 10 μm in order that the toner has both heat-resistant preservability and low-temperature fixability.

The following describes the toner core (a binder resin and an internal additive), the shell layer, and the external additive in order. A component (for example, an internal additive) that is not necessary may be omitted according to the purpose of the toner.

<Preferable Thermoplastic Resin>

Preferable examples of a thermoplastic resin forming the toner particle (particularly, toner core and shell layer) include styrene-based resin, acrylic acid-based resins (specific examples include acrylic acid ester polymer and methacrylic acid ester polymer), olefin-based resins (specific examples include polyethylene resin and polypropylene resin), vinyl chloride resin, polyvinyl alcohol, vinyl ether resin, N-vinyl resin, polyester resin, polyamide resin, and urethane resin. Copolymers of the resins listed above, that is, copolymers of the respective resins listed above into which an arbitrary repeating unit is introduced (specific examples include a styrene-acrylic acid-based resin and a styrene-butadiene-based resin) are also preferable as the thermoplastic resin forming the toner particle.

The styrene-acrylic acid-based resin is a copolymer of at least one styrene-based monomer and at least one acrylic acid-based monomer. Styrene-based monomers and acrylic acid-based monomers listed below can be preferably used for example for synthesis of the styrene-acrylic acid-based resin. Use of an acrylic acid-based monomer having a carboxyl group can result in introduction of the carboxyl group into the styrene-acrylic acid-based resin. Also, use of a monomer having a hydroxyl group (specific examples include p-hydroxystyrene, m-hydroxystyrene, and (meth) acrylic acid hydroxyalkyl ester) can result in introduction of the hydroxyl group into the styrene-acrylic acid-based resin. The acid value of a resultant styrene-acrylic acid-based resin can be adjusted by adjusting the amount of an acrylic acid-based monomer. The hydroxyl value of the resultant styrene-acrylic acid-based resin can be adjusted by adjusting the amount of a monomer having the hydroxyl group.

Preferable examples of the styrene-based monomer include styrene, alkylstyrenes (specific examples include α-methylstyrene, m-methylstyrene, p-methylstyrene, and p-ethylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Preferable examples of the acrylic acid-based monomer include (meth)acrylic acid, (meth)acrylic acid alkyl ester, and (meth)acrylic acid hydroxyalkyl ester. Preferable examples of the (meth)acrylic acid alkyl ester include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate. Preferable examples of the (meth)acrylic acid hydroxyalkyl ester include 2-hydroxyethyl (meth)acrylate, 3-hydroxypropyl (meth)acrylate, 2-hydroxyproply (meth) acrylate, and 4-hydroxybutyl (meth)acrylate.

The polyester resin can be yielded by condensation polymerization between at least one polyhydric alcohol and at least one polybasic carboxylic acid. Examples of an alcohol that can be preferably used for synthesis of the polyester resin include dihydric alcohols (specific examples include aliphatic diols and bisphenols) and tri- or higher-hydric alcohols listed below. Examples of a carboxylic acid that can be preferably used for synthesis of the polyester resin include dihydric carboxylic acids and tri- or higher-carboxylic acids listed below. The acid value and the hydroxyl value of the polyester resin can be adjusted by adjusting the respective amounts of the alcohol and the carboxylic acid used in synthesis of the polyester resin. Increasing the molecular weight of the polyester resin tends to decrease the acid value and the hydroxyl value of the polyester resin.

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include aromatic dicarboxylic acids (specific examples include phthalic acid, terephthalic acid, and isophthalic acid), α,ω-alkanedicarboxylic acids (specific examples include malonic acid, succinic acid, adipic acid, suberic acid, azelaic acid, sebacic acid, and 1,10-decanedicarboxylici acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycroalkanedicarboxylic acids (specifically, cyclohexanedicarboxylic acid and the like).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

A binder resin is typically a main component (for example, at least 85% by mass) of the toner cores. Properties of the binder resin are therefore expected to have great influence on an overall property of the toner core. The properties of the binder resin (specific examples include hydroxyl value, acid value, Tg, and Tm) can be adjusted through use of a combination of plural types of resins as the binder resin. The toner cores have a strong tendency to be anionic when the binder resin has a group such as an ester group, a hydroxyl group, an ether group, an acid group, or a methyl group. By contrast, the toner cores have a strong tendency to be cationic when the binder resin has a group such as an amino group or an amide group. Preferably, at least one of the hydroxyl value and the acid value of the binder resin is at least 10 mgKOH/g in order to increase bondability (reactivity) between the toner core and the shell layer.

A thermoplastic resin (specific examples include the resins listed in "Preferable Thermoplastic Resin") is preferable as the binder resin of the toner cores. The styrene-acrylic acid-based resin or the polyester resin is particularly preferable as the binder resin in order to improve dispersibility of a colorant in the toner core, chargeability of the toner, and fixability of the toner to a recording medium.

In a situation in which a styrene-acrylic acid-based resin is used as the binder resin of the toner core, the styrene-acrylic acid-based resin preferably has a number average molecular weight (Mn) of at least 2,000 and no greater than 3,000 in order to improve strength of the toner cores and fixability of the toner. The styrene-acrylic acid-based resin preferably has a molecular weight distribution (ratio Mw/Mn of mass average molecular weight (Mw) relative to number average molecular weight (Mn)) of at least 10 and no greater than 20.

In a situation in which a polyester resin is used as the binder resin of the toner core, the polyester resin preferably has a number average molecular weight (Mn) of at least 1,000 and no greater than 2,000 in order to improve strength of the toner cores and fixability of the toner. The polyester resin preferably has a molecular weight distribution (ratio Mw/Mn of mass average molecular weight (Mw) relative to number average molecular weight (Mn)) of at least 9 and no greater than 21.

(Colorant)

The toner core may optionally contain a colorant. The colorant can be a known pigment or dye that matches the color of the toner. The amount of the colorant is preferably at least 1 part by mass and no greater than 20 parts by mass relative to 100 parts by mass of the binder resin in order that high-quality images are formed with the toner.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can be used for example as a yellow colorant. Examples of a yellow colorant that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as a magenta colorant. Examples of a magenta colorant that can be preferably used include C. I. Pigment Red (for example, (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as a cyan colorant. Examples of a cyan colorant that can be preferably used include C. I. Pigment Blue (1, 7, 15, 15:1, 5:2, 15:3, 15:4, 60, 62, and 66), Phthalocyanine Blue, C. I. Vat Blue, and C. I. Acid Blue.

(Releasing Agent)

The toner core may optionally contain a releasing agent. The releasing agent is for example used for the purpose of improving fixability of the toner or resistance of the toner to being offset. The toner cores are preferably produced with an anionic wax in order to increase anionic strength of the toner cores. The amount of the releasing agent is preferably at least 1 part by mass and no greater than 30 parts by mass relative to 100 parts by mass of the binder resin in order to improve fixability or offset resistance of the toner.

Examples of a releasing agent that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a major component such as montanic acid ester wax and castor wax; and waxes containing partially or fully deoxidized fatty acid esters such as deoxidized carnauba wax. One of the releasing agents listed above may be used alone, or two or more of the releasing agents listed above may be used in combination.

A compatibilizer may be added to the toner core in order to improve compatibility between the binder resin and the releasing agent.

(Charge Control Agent)

The toner core may optionally contain a charge control agent. The charge control agent is for example used for the purpose of improving charge stability or a charge rise characteristic of the toner. The charge rise characteristic of the toner is an indicator as to whether the toner can be charged to a specific charge level in a short period of time.

Anionic strength of the toner cores can be increased by including a negatively chargeable charge control agent (specific examples include organic metal complexes and chelate compounds) in the toner core. Cationic strength of the toner cores can be increased by including a positively chargeable charge control agent (specific examples include pyridine, nigrosine, and quaternary ammonium salts) in the toner core. However, the toner cores need not contain a charge control agent in a configuration in which sufficient chargeability of the toner can be ensured.

(Magnetic Powder) The toner core may optionally contain a magnetic powder. Examples of a material of the magnetic powder that can be preferably used include ferromagnetic metals (specific examples include iron, cobalt, nickel, and alloys of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). One of the magnetic powders listed above may be used alone, or two or more of the magnetic powders listed above may be used in combination.

The magnetic powder is preferably subjected to surface treatment in order to inhibit elution of metal ions (e.g., iron ions) from the magnetic powder. In a situation in which the shell layers are formed over the surfaces of the toner cores under acidic conditions, elution of metal ions to the surfaces of the cores causes the cores to adhere to one another more readily. It is thought that inhibition of elution of metal ions from the magnetic powder can inhibit toner cores from adhering to one another.

[Shell Layer]

The toner according to the present embodiment has the aforementioned basic features. The shell layer includes the film-shaped first domains and the particle-shaped second domains. The first domains are substantially formed from a non-cross-linked resin. The second domains are substantially formed from a cross-linked resin.

The non-cross-linked resin forming the first domains is preferably a non-cross-linked thermoplastic resin (specific examples include the resins listed in "Preferable Thermoplastic Resin") in order that the toner has both heat-resistant preservability and low-temperature fixability, with a non-cross-linked styrene-acrylic acid-based resin being particularly preferable.

The cross-linked resin forming the second domains is preferably a thermoplastic resin (specific examples include the resins listed in "Preferable Thermoplastic Resin") having a cross-linking structure in order that the toner has both heat-resistant preservability and low-temperature fixability with a cross-linked acrylic acid-based resin being particularly preferable.

It is particularly preferable that the non-cross-linked resin forming the first domains is a non-cross-linked styrene-acrylic acid-based resin and the cross-linked resin forming the second domains is a cross-linked acrylic acid-based resin in order to produce a toner suitable for image formation. A polymer of monomers (resin raw materials) including at least one styrene-based monomer (for example, styrene), at least one (meth)acrylic acid ester (for example, ethyl acrylate), and at least one (meth)acrylic acid hydroxyalkyl ester (for example, 2-hydroxybutyl methacrylate) is particularly preferable as the non-cross-linked styrene-acrylic acid-based resin. A polymer of monomers (resin raw materials) including at least one (meth)acrylic acid ester (for example, methyl methacrylate) and at least one (meth)acrylic acid ester of alkyleneglycols is particularly preferable as the cross-linked acrylic acid-based resin. An example of a cross-linking agent for introducing cross-linking structure into an acrylic acid-based resin include (meth)acrylic acid esters of alkyleneglycol (for example, butylene glycol di(meth)acrylate).

The shell layer preferably contains a cationic surfactant in order to increase positive chargeability of the toner. For example, when a cationic surfactant used for forming the shell layers is allowed to remain on purpose rather than being removed, the cationic surfactant can be contained in the shell layers. Preferable examples of the cationic surfactant contained in the shell layer include amine salts (for example, primary amine acetate) and quaternary ammonium salts (specific examples include alkyl trimethyl ammonium salt, dialkyl dimethyl ammonium salt, alkyl benzyl dimethyl ammonium salt, acryloyloxyalkyl trimethyl ammonium salt, methacryloyloxy alkyl trimethyl ammonium salt, and benzethonium chloride salt).

[External Additive]

Inorganic particles are attached to the surface of the toner mother particle as an external additive. Unlike the internal additive, the external additive is absent from the interior of the toner mother particle and selectively present only on the surface of the toner mother particle (surface layer portion of toner particle). When the toner mother particles (power) and the external additive (power) are stirred together, external additive particles can be attached to the surfaces of the toner mother particles. The toner mother particle does not chemically react with the external additive particles and is bonded to each other physically rather than chemically. Bonding strength between the toner mother particle and the external additive particles can be adjusted according to stirring conditions (specific examples include period and rotational speed of stirring) and size, shape, and surface condition of the external additive particles. The amount of the external additive (where plural types of external additive particles are used, total amount of the external additive particles) is preferably at least 0.5 parts by mass and no greater than 10 parts by mass relative to 100 parts by mass of the toner mother particles in order that functions of the external additive are satisfactorily exhibited while desorption of the external additive particles from the toner particles is inhibited. In order to improve fluidity or handling property of the toner, the external additive preferably has a particle diameter of at least 0.01 μm and no greater than 1.0 μm.

Examples of external additive particles (inorganic particles) that can be preferably used include silica particles and particles of metal oxides (specific examples include alumina, titanium oxide, magnesium oxide, zinc oxide, strontium titanate, and barium titanate). One type of external additive particles may be used alone, or two or more types of external additive particles may be used in combination.

The external additive particles may be subjected to surface treatment. In a situation for example in which silica particles are used as the external additive particles, hydrophobicity and/or positive chargeability may be imparted to the surfaces of the silica particles with a surface preparation agent. Examples of a surface preparation agent that can be preferably used include coupling agents (specific examples include a silane coupling agent, a titanate coupling agent, and an alminate coupling agent), silazane compounds (for example, chain silazane compounds and cyclic silazane compounds), and silicone oils (specific example is dimethyl silicone oil). A silane coupling agent or a silazane compound is particularly preferable as the surface preparation agent. Preferable examples of the silane coupling agent include silane compounds (specific examples include methyltrimethoxysilane and aminosilane). A preferable example of the silazane compound is hexamethyldisilazane (HMDS).

When the surface of a silica base (non-treated silica particles) are surface treated with a surface preparation agent, multiple hydroxyl groups (—OH) present on the surface of the silica base are partly or wholly substituted with a functional group derived from the surface preparation agent. As a result, silica particles can be obtained that each have a surface on which the functional group derived from the surface preparation agent (specifically, functional group having stronger hydrophobicity and/or positive chargeability than the hydroxyl groups) is present. In a situation for example in which the surface of the silica base is treated with a silane coupling agent having an amino group, a dehydration condensation reaction is caused between a hydroxyl group of the silane coupling agent (for example, hydroxyl group generated by hydrolysis of an alkoxy group of the silane coupling agent with moisture) and a hydroxyl group present on the surface of the silica base ("A (silica base)-OH"+"B (coupling agent)-OH"→"A-O—B"+$H_2O$). When the silane coupling agent having the amino group is chemically bonded to silica through the reaction as above, the amino group is provided to the surfaces of the silica particles, thereby obtaining positively chargeable silica particles. More specifically, the hydroxyl group present on the surface of the silica base is substituted with a functional group having a terminal amino group (specifically, —O—Si—$(CH_2)_3$—$NH_2$ or the like). The silica particles to which the amino group is provided tend to have stronger positive chargeability than the silica base. When a silane coupling agent having an alkyl group is used, hydrophobic silica particles can be obtained. More specifically, the hydroxyl group present on the surface of the silica base can be substituted with a functional group having a terminal alkyl group (specifically, —O—Si—$CH_3$ or the like) through the above dehydration condensation reaction. As described above, the silica particles to which a hydrophobic group (alkyl group) is provided rather than a hydrophilic group (hydroxyl group) tend to have stronger hydrophobicity than the silica base.

Inorganic particles each having a conductive layer may be used as the external additive particles. The conductive layer is for example a film (specifically, Sb-doped $SnO_2$ film or the like) of a metal oxide (also referred to below as a doped metal oxide) to which conductivity is imparted by doping. Alternatively, the conductive layer may be a layer containing a conductive material (specific examples include metal, carbon material, and conductive macromolecule) other than the doped metal oxide.

[Toner Production Method]

Following describes an example of a method for producing the toner according to the present embodiment that has the aforementioned features.

(Toner Core Preparation)

The toner cores are preferably produced by a aggregation method or a pulverization method in order to easily obtain preferable toner cores with the pulverization method being more preferable.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is then pulverized and the resultant pulverized substance is classified. Through the above processes, toner cores having a desired particle diameter are obtained.

An example of the aggregation method will be described below. First, a binder resin, a releasing agent, and a colorant each in the form of fine particles are caused to aggregate in an aqueous medium containing these particles to form particles having a desired particle diameter. As a result, aggregated particles containing the binder resin, the releasing agent, and the colorant are formed. Subsequently, the resultant aggregated particles are heated for coalescence of the components contained in the aggregated particles. As a result, a dispersion of the toner cores is obtained. Thereafter, unnecessary substances (surfactant and the like) are removed from the dispersion of the toner cores to obtain the toner cores.

(First Domain Formation)

The first domains of the shell layers are formed preferably in an aqueous medium in order to inhibit dissolution or elution of toner core components (particularly, the binder resin and the releasing agent) in formation of the first domains of the shell layers. The aqueous medium is a medium containing water as a major component (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. Examples of a polar medium in the aqueous medium that can be used include alcohols (specific examples include methanol and ethanol). The aqueous medium has a boiling point of approximately 100° C.

For example, ion-exchanged water is prepared as the aqueous medium. Subsequently, the pH of the aqueous medium is adjusted to a specific pH (for example, a pH of at least 3 and no greater than 5) for example with use of hydrochloric acid. The toner cores and a suspension of a non-cross-linked resin (liquid containing non-cross-linked resin particles) are added to the aqueous medium of which pH has been adjusted (for example, acidic aqueous medium).

The non-cross-linked resin particles are attached to the surface of the toner core in the liquid. Preferably, the toner cores are highly dispersed in the liquid including the non-cross-linked resin particles in order that the non-cross-linked resin particles are regularly attached to the surfaces of the toner cores. A surfactant may be contained in the liquid or the liquid may be stirred using a powerful stirrer (for example, "Hivis Disper Mix" produced by PRIMIX Corporation) in order to highly disperse the toner cores in the liquid. Examples of a surfactant that can be used include sulfate ester salt, sulfonate salt, phosphate ester salt, and soap.

Subsequently, the temperature of the liquid containing the toner cores and the non-cross-linked resin particles is increased to a specific holding temperature (preferably a temperature satisfying (Tg of non-cross-linked resin)−5°

C.≤(holding temperature)≤(Tg of non-cross-linked resin)+20° C.) at a specific speed (for example, at least 0.1° C./min. and no greater than 3° C./min.) while the liquid is stirred. The temperature of the liquid after temperature increase (after the temperature of the liquid reaches the holding temperature) may be kept at the holding temperature for a specific time period (for example, at least one minute and no greater than 60 minutes) while the liquid is stirred. A non-cross-linked resin film piece (first domain) is formed on the surface of the toner core during temperature increase (during the time when the temperature of the liquid is increased to the holding temperature) or a period of temperature keeping after temperature increase (during the time when the temperature of the liquid is kept at the holding temperature). Toner cores with the first domains thereon will be referred below to as first covered cores.

Next, the dispersion of the first covered cores obtained as above is neutralized for example with use of sodium hydroxide. Subsequently, the dispersion of the first covered cores is cooled for example to normal temperature (approximately 25° C.). The dispersion of the first covered cores is then filtered using for example a Buchner funnel. Through the above filtration, the first covered cores are separated (solid-liquid separation) from the liquid with a result that a wet cake of the first covered cores is collected. The collected wet cake of the first covered cores is washed then. The washed first covered cores are dried then.

(Second Domain Formation)

Next, the first covered cores (powder) and cross-linked resin particles (powder) are mixed together for a specific time period (for example, at least 30 seconds and no greater than two minutes) using a mixer (for example, FM mixer produced by Nippon Coke & Engineering Co., Ltd.) to attach the cross-linked resin particles to the surface of the first covered core. Through the above, toner mother particles (powder) are obtained.

The present inventor has found that the surface adsorption force of the second domains is different between second domains subjected to wet fixation and second domains subjected to dry fixation. In wet fixation, it is highly possible that a side material (specifically, surfactant or the like) remains on the surfaces of the second domains. Also in wet fixation, it is necessary to fix the second domains (cross-linked resin particles) on the surfaces of the first covered cores in a liquid at high temperature. By contrast, the second domains (cross-linked resin particles) can be fixed on the surfaces of the first covered cores at room temperature (approximately 25° C.) or lower in dry fixation. Such difference in condition for fixation (particularly, differences in treatment environment and treatment temperature) is thought to bring difference in surface adsorption force of the second domains.

An FM mixer includes a mixing tank equipped with temperature adjusting jacket and additionally includes a deflector, temperature sensor, and upper and lower vanes in the interior of the mixing tank. In a situation in which a material (specific examples include powder and slurry) loaded into the mixing tank of the FM mixer is mixed, the material in the mixing tank is caused to flow in an up-and-down direction while being circulated by rotation of the lower vane. This causes a convection current of the material in the mixing tank. The upper vane in high-speed rotation provides shear force to the material. The FM mixer applies shear stress to the material to enable mixing of the material by strong mixing power.

(External Addition Process)

Subsequently, the toner mother particles and the external additive (inorganic particles) are mixed together for a specific time period (for example, at least three minutes and no greater than eight minutes) using a mixer (for example, FM mixer produced by Nippon Coke & Engineering Co., Ltd.) to attach the external additive to the surface of the toner mother particle. Note that in a situation in which a spray dryer is used in a drying process, the drying process and the external addition process can be carried out simultaneously by spraying a dispersion of the external additive (inorganic particles) toward the toner mother particles. As a result, a toner including multiple toner particles is produced.

Note that processes and order of the toner production method described above may be changed freely in accordance with desired structure, characteristics, or the like of the toner. For example, in order to cause reaction of a material (for example, shell material) in a liquid, the material may be allowed to react in the liquid for a specific time period after addition of the material to the liquid or the material may be allowed to react in the liquid while being added to the liquid through addition of the material to the liquid over a long period of time. The shell material may be added to the liquid as a single addition or may be divided up and added to the liquid as a plurality of additions. The toner may be sifted after the external addition process. Further, non-essential processes may alternatively be omitted. For example, in a situation in which a commercially available product can be used directly as a material, use of the commercially available product can omit the process of preparing the material. In a situation in which reaction for shell layer formation progresses favorably even without pH adjustment of the liquid, a process of pH adjustment may be omitted. A prepolymer may be used rather than a monomer as a material for resin synthesis. In addition, a salt, ester, hydrate, or anhydride of a specific compound may be used as a raw material in order to yield the compound. Preferably, a large number of the toner particles are formed at the same time in order to produce the toner efficiently. The toner particles produced at the same time are thought to have substantially the same configuration.

Examples

Following describes examples of the present invention. Table 1 indicates toners T-1-T-11 (each are an electrostatic latent image developing toner) of examples and comparative examples.

TABLE 1

| | Shell layer | | | | | |
|---|---|---|---|---|---|---|
| | Non-cross-linked domain | | Cross-linked domain | | | |
| Toner | Type | First surface adsorption force [nN] | Type | Second surface adsorption force [nN] | Tg difference (cross-linked − non-cross-linked) [° C.] | First coverage ratio [%] |
| T-1 | A-1 | 39.1 | B-3 | 6.0 | 62 (=130 − 68) | 69 |
| T-2 | A-2 | 32.1 | B-3 | 4.8 | 57 (=130 − 73) | 58 |
| T-3 | A-3 | 22.3 | B-3 | 5.2 | 48 (=130 − 82) | 43 |
| T-4 | A-2 | 33.2 | B-2 | 11.9 | 49 (=122 − 73) | 71 |
| T-5 | A-1 | 36.5 | B-1 | 18.1 | 46 (=114 − 68) | 77 |
| T-6 | A-3 | 25.6 | B-2 | 10.3 | 40 (=122 − 82) | 49 |
| T-7 | A-2 | 32.0 | — | — | — | 74 |
| T-8 | A-5 | 19.3 | B-3 | 6.0 | 46 (=130 − 84) | 54 |
| T-9 | A-4 | 41.6 | B-3 | 8.0 | 65 (=130 − 65) | 80 |

TABLE 1-continued

| | Shell layer | | | | | |
|---|---|---|---|---|---|---|
| | Non-cross-linked domain | | Cross-linked domain | | | |
| Toner | Type | First surface adsorption force [nN] | Type | Second surface adsorption force [nN] | Tg difference (cross-linked − non-cross-linked) [° C.] | First coverage ratio [%] |
| T-10 | A-4 | 39.8 | B-4 | 21.0 | 41 (=106 − 65) | 68 |
| T-11 | A-1 | 37.3 | B-4 | 19.8 | 38 (=106 − 68) | 73 |

The following describes methods for producing the respective toners T-1-T-11, evaluation methods, and evaluation results in order. In evaluations in which errors may occur, an evaluation value was calculated by calculating the arithmetic mean of an appropriate number of measurement values in order to ensure that any errors were sufficiently small. The number average particle diameter of a powder was measured using a scanning electron microscope (SEM). Respective measuring methods of Tg (glass transition point), Mp (melting point), and Tm (softening point) are those described below unless otherwise stated.

<Methods for Measuring Tg and Mp>

A differential scanning calorimeter ("DSC-6220" produced by Seiko Instruments Inc.) was used as a measuring device. A heat absorption curve of a sample (for example, resin) was plotted using the measuring device to obtain Tg and Mp of the sample. Specifically, 15 mg of the sample (for example, resin) was put on an aluminum pan (aluminum vessel) and the aluminum pan was set on a measurement section of the measuring device. An empty aluminum pan was used as a reference. In heat absorption curve plotting, the temperature of the measurement section was increased from 10° C. that was a measurement start temperature to 150° C. at a rate of 10° C./min. (RUN 1). Then, the temperature of the measurement section was decreased from 150° C. to 10° C. at a rate of 10° C./min. Subsequently, the temperature of the measurement section was re-increased from 10° C. to 150° C. at a rate of 10° C./min. (RUN 2). The heat absorption curve (vertical axis: heat flow (DSC signal), horizontal axis: temperature) of the sample was plotted through RUN 2. Mp and Tg of the sample were read from the plotted heat absorption curve. Mp (melting point) of the sample is a maximum peak temperature in the heat absorption curve that is due to heat of fusion. Tg (glass transition point) of the sample is a temperature (onset temperature) at a point of change in specific heat on the heat absorption curve (i.e., an intersection point of an extrapolation of the base line and an extrapolation of the inclined portion of the curve).

<Method for Measuring Tm>

A sample (for example, resin) was set in the capillary rheometer ("CFT-500D" produced by Shimadzu Corporation), and the sample having a volume of 1 $cm^3$ is allowed to melt-flow under conditions of a die pore size of 1 mm, a plunger load of 20 $kg/cm^2$, and a heating rate of 6° C./min. to plot an S-shaped curve (horizontal axis: temperature, vertical axis: stroke) of the sample. Tm of the sample was then read from the plotted S-shaped curve. Tm (softening point) of the sample is a temperature on the S-shaped curve corresponding to a stroke value of "$(S_1+S_2)/2$", where $S_1$ represents a maximum stroke value and $S_2$ represents a base line stroke value at low temperatures.

[Toner Production Method]

(Synthesis of Crystalline Polyester Resin)

A 10-L four-necked flask equipped with a thermometer (thermocouple), a dewatering conduit, a nitrogen inlet tube, and a stirrer was charged with 2,643 g of 1,6-hexanediol, 864 g of 1,4-butanediol, and 2,945 g of succinic acid. Next, the flask contents were heated to 160° C. to melt the added materials. A mixed liquid of styrene and the like (mixed liquid of 1,831 g of styrene, 161 g of acrylic acid, and 110 g of dicumyl peroxide) was gradually added to the flask drop-wise over one hour using a dripping funnel. The flask contents were then allowed to react at temperature of 170° C. for one hour while being stirred for polymerization of styrene and acrylic acid in the flask. Thereafter, the flask contents were kept in a reduced pressure atmosphere (pressure of 8.3 kPa) for one hour to remove non-reacted styrene and non-reacted acrylic acid from the flask. Subsequently, 40 g of tin(II) 2-ethylhexanoate and 3 g of gallic acid were added to the flask. Next, the flask contents were heated and kept at 210° C. for eight hours for reaction. The flask contents were then allowed to react for one hour at a temperature of 210° C. in a reduced pressure atmosphere (pressure of 8.3 kPa). As a result, a crystalline polyester resin having a Tm of 92° C., a Mp of 96° C., and a crystallinity index of 0.95 was obtained.

(Synthesis of Non-Crystalline Polyester Resin A)

A 10-L four-necked flask equipped with a thermometer (thermocouple), a dewatering conduit, a nitrogen inlet tube, and a stirrer was charged with 370 g of bisphenol A propylene oxide adduct, 3,059 g of bisphenol A ethylene oxide adduct, 1,194 g of terephthalic acid, 286 g of fumaric acid, 10 g of tin(II) 2-ethylhexanoate, and 2 g of gallic acid. Subsequently, the flask contents were allowed to react at a temperature of 230° C. in a nitrogen atmosphere until a reaction rate became at least 90% by mass. The reaction rate was calculated according to an expression "(reaction rate)=100×(actual amount of reaction product water)/(theoretical amount of reaction product water)". Next, the flask contents were allowed to react in a reduced pressure atmosphere (pressure: 8.3 kPa) until Tm of a reaction product (resin) became a specific temperature (89° C.). As a result, a non-crystalline polyester resin A having a Tm of 89° C. and a Tg of 50° C. was obtained.

(Synthesis of Non-Crystalline Polyester Resin B)

A non-crystalline polyester resin B was synthesized according to the same method as the non-crystalline polyester resin A in all aspect other than that 1,286 g of bisphenol A propylene oxide adduct, 2,218 g of bisphenol A ethylene oxide adduct, and 1,603 g of terephthalic acid were used in place of 370 g of bisphenol A propylene oxide adduct, 3,059 g of bisphenol A ethylene oxide adduct, 1,194 g of terephthalic acid, and 286 g of fumaric acid. The non-crystalline polyester resin B had a Tm of 111° C. and a Tg of 69° C.

(Synthesis of Non-Crystalline Polyester Resin C)

A 10-L four-necked flask equipped with a thermometer (thermocouple), a dewatering conduit, a nitrogen inlet tube, and a stirrer was charged with 4,907 g of bisphenol A propylene oxide adduct, 1,942 g of bisphenol A ethylene oxide adduct, 757 g of fumaric acid, 2,078 g of dodecylsuccinic anhydride, 30 g of tin(II) 2-ethylhexanoate, and 2 g of gallic acid. Subsequently, the flask contents were allowed to react at a temperature of 230° C. in a nitrogen atmosphere until the reaction rate expressed by the aforementioned expression became at least 90% by mass. The flask contents were then allowed to react for one hour in a reduced pressure atmosphere (pressure of 8.3 kPa). Next, 548 g of trimellitic anhydride was added to the flask and the flask contents were allowed to react at a temperature of 220° C. in a reduced pressure atmosphere (pressure: 8.3 kPa) until Tm of a reaction product (resin) became a specific temperature (127° C.). As a result, a non-crystalline polyester resin C having a Tm of 127° C. and a Tg of 51° C. was obtained.

(Preparation of Suspension A-1)

A 1-L three-necked flask equipped with a thermometer and a stirring impeller was set in a water bath, and 875 mL of ion-exchanged water at a temperature of 30° C. and 75 mL of a cationic surfactant ("Texnol (registered Japanese trademark) R5" produced by NIPPON NYUKAZAI CO., LTD., component: alkyl benzyl dimethyl ammonium salt) were added to the flask. Next, the internal temperature of the flask was increased to 80° C. using the water bath. Then, two liquids (a first liquid and a second liquid) were each added drop-wise to the flask contents at a temperature of 80° C. over five hours. The first liquid was a mixed liquid of 12 mL of styrene, 4 mL of 2-hydroxybutyl methacrylate, and 4 mL of ethyl acrylate. The second liquid was a solution of 30 mL of ion-exchanged water in which 0.5 g of potassium peroxodisulfate was dissolved. Then, the flask contents were polymerized in a state in which the internal temperature of the flask was kept at 80° C. for two hours. As a result, a suspension A-1 of resin fine particles (non-cross-linked resin particles) was obtained. The resin fine particles contained in the resultant suspension A-1 had a number average particle diameter of 53 nm.

(Preparation of Suspension A-2)

A suspension A-2 was prepared according to the same method as the suspension A-1 in all aspects other than that the additive amounts of the respective material were changed. Specifically: the amount of styrene was changed from 12 mL to 13 mL; the amount of 2-hydroxybutyl methacrylate was changed from 4 mL to 5 mL; and the amount of ethyl acrylate was changed from 4 mL to 3 mL. Resin fine particles contained in the resultant suspension A-2 had a number average particle diameter of 55 nm.

(Preparation of Suspension A-3)

A suspension A-3 was prepared according to the same method as the suspension A-1 in all aspects other than that the amount of the cationic surfactant (Texnol R5) was changed from 75 mL to 5 mL and the first liquid was a mixed liquid of 13 mL of styrene, 6 mL of 2-hydroxyethyl methacrylate, and 2 mL of methyl acrylate rather than the mixed liquid of 12 mL of styrene, 4 mL of 2-hydroxybutyl methacrylate, and 4 mL of ethyl acrylate. Resin fine particles (non-cross-linked resin particles) contained in the resultant suspension A-3 had a number average particle diameter of 52 nm.

(Preparation of Suspension A-4)

A suspension A-4 was prepared according to the same method as the suspension A-1 in all aspects other than that the amount of the cationic surfactant (Texnol R5) was changed from 75 mL to 5 mL and the first liquid was a mixed liquid of 12 mL of styrene, 2 mL of 2-hydroxybutyl methacrylate, and 4 mL of butyl acrylate rather than the mixed liquid of 12 mL of styrene, 4 mL of 2-hydroxybutyl methacrylate, and 4 mL of ethyl acrylate. Resin fine particles (non-cross-linked resin particles) contained in the resultant suspension A-4 had a number average particle diameter of 53 nm.

(Preparation of Suspension A-5)

A suspension A-5 was prepared according to the same method as the suspension A-1 in all aspects other than that the amount of the cationic surfactant (Texnol R5) was changed from 75 mL to 5 mL and the first liquid was a mixed liquid of 12 mL of styrene, 7 mL of 2-hydroxyethyl methacrylate, and 2 mL of methyl acrylate rather than the mixed liquid of 12 mL of styrene, 4 mL of 2-hydroxybutyl methacrylate, and 4 mL of ethyl acrylate. Resin fine particles (non-cross-linked resin particles) contained in the resultant suspension A-5 had a number average particle diameter of 56 nm.

(Preparation of Resin Powder B-1)

A 3-L flask equipped with a thermometer (thermocouple), a nitrogen inlet tube, a stirrer, and a heat exchanger (condenser) was charged with 1,000 g of ion-exchanged water at a temperature of approximately 30° C. and 4 g of a cationic surfactant ("Texnol R5" produced by NIPPON NYUKAZAI CO., LTD., component: alkyl benzyl dimethyl ammonium salt). Subsequently, nitrogen was introduced into the flask while the flask contents were stirred for 30 minutes for nitrogen substitution. Thereafter, 2 g of potassium peroxodisulfate was added to the flask. The flask contents were then stirred to dissolve potassium peroxodisulfate. Subsequently, the internal temperature of the flask was increased to 80° C. while nitrogen was introduced into the flask. A mixed liquid of 250 g of methyl methacrylate and 4 g of 1,4-butanediol dimethacrylate was gradually added to the flask drop-wise over two hours starting from a time point when the internal temperature of the flask reached 80° C. During the dropwise addition of the mixed liquid, the flask contents were kept stirred under conditions of a temperature of 80° C. and a rotational speed of 300 rpm. After the drop-wise addition, the internal temperature of the flask was kept at 80° C. for additional eight hours. During the internal temperature of the flask being kept at high temperature (80° C.), the flask contents were polymerized, thereby obtaining a suspension of resin fine particles. Subsequently, the resultant suspension of the resin fine particles was filtered and dried to obtain a resin powder (powder of cross-linked resin) B-1. The resin fine particles contained in the resultant resin powder B-1 had a number average particle diameter of 84 nm.

(Preparation of Resin Powder B-2).

A resin powder B-2 was prepared according to the same method as the resin powder B-1 in all aspects other than that a mixed liquid of 250 g of methyl methacrylate and 4 g of ethylene glycol dimethacrylate was used rather than the mixed liquid of 250 g of methyl methacrylate and 4 g of 1,4-butanediol dimethacrylte. Resin fine particles contained in the resultant resin powder (powder of cross-linked resin) B-2 had a number average particle diameter of 84 nm.

(Preparation of Resin Powder B-3)

A resin powder B-3 was prepared according to the same method as the resin powder B-2 in all aspects other than that the amount of ethylene glycol dimethacrylate was changed from 4 g to 5 g. Resin fine particles contained in the resultant resin powder (powder of cross-linked resin) B-3 had a number average particle diameter of 90 nm.

(Preparation of Resin Powder B-4)

A resin powder B-4 was prepared according to the same method as the resin powder B-1 in all aspects other than that the amount of 1,4-butanediol dimethacrylate was changed from 4 g to 3 g. Resin fine particles contained in the resultant resin powder (powder of cross-linked resin) B-4 had a number average particle diameter of 77 nm.

Table 1 lists the glass transition points (Tg) of the respective types of resin fine particles contained in the suspensions A-1-A-5 or included in the resin powders B-1-B-4. For example, the resin fine particles (non-cross-linked resin particles) contained in the suspension A-1 had a glass transition point (Tg) of 68° C. The resin fine particles (cross-linked resin particles) included in the resin powder B-3 had a glass transition point (Tg) of 130° C.

(Preparation of Toner Cores)

An FM mixer ("FM-20B" produced by Nippon Coke & Engineering Co., Ltd.) was used to mix 100 g of a first binder resin (crystalline polyester resin synthesized according to the aforementioned processes), 300 g of a second binder resin (non-crystalline polyester resin A synthesized according to the aforementioned processes), 100 g of a third binder resin (non-crystalline polyester resin B synthesized according to the aforementioned processes), 600 g of a fourth binder resin (non-crystalline polyester resin C synthesized according to the aforementioned processes), 144 g of a colorant ("Colortex (registered Japanese trademark) Blue B1021" produced by SANYO COLOR WORKS, Ltd., component: Phthalocyanine Blue), 12 g of a first releasing agent ("Carnauba Wax No. 1" produced by S. Kato & Co., component: carnauba wax), and 48 g of a second releasing agent ("NISSAN ELECTOR (registered Japanese trademark) WEP-3" produced by NOF Corporation, component: ester wax) at a rotational speed of 2,400 rpm.

Subsequently, the resulting mixture was melt-kneaded using a twin-screw extruder ("PCM-30" product by Ikegai Corp.) under conditions of a material feeding speed of 5 kg/hour, a shaft rotational speed of 160 rpm, and a set temperature (cylinder temperature) of 100° C. The resultant melt-knead product was then cooled. Next, the kneaded product cooled as above was coarsely pulverized using a pulverizer ("Rotoplex (registered Japanese trademark)" produced by Hosokawa Micron Corporation). The resultant coarsely pulverized product then was finely pulverized using a jet mill ("Model-I Super Sonic Jet Mill" produced by Nippon Pneumatic Mfg. Co., Ltd.). Next, the resultant finely pulverized product was classified using a classifier ("Elbow Jet EJ-LABO" produced by Nittetsu Mining Co., Ltd.). As a result, toner cores having a Tg of 36° C. and a volume median diameter ($D_{50}$) of 6 μm were obtained.

(Film-shaped Domain Formation Process)

A 1-L three-necked flask equipped with a thermometer and a stirring impeller was set in a water bath and 300 mL of ion-exchanged water was added to the flask. Next, the internal temperature of the flask was kept at 30° C. using the water bath. Dilute hydrochloric acid was then added to the flask to adjust the pH of the flask contents to 4. Subsequently, 15 mL of a suspension containing non-cross-linked resin particles (any of the suspensions A-1-A-5 listed in Table 1 for the respective toners) was added to the flask. For example, 15 mL of the suspension A-1 was added to the flask in production of the toner T-1. Next, 300 g of the toner cores (toner cores prepared according to the aforementioned process) were added to the flask and the flask contents were stirred at a rotational speed of 300 rpm for one hour. Next, 300 mL of ion-exchanged water was added to the flask.

Thereafter, the internal temperature of the flask was increased up to 78° C. at a rate of 1° C./min. while the flask contents were stirred at a rotational speed of 100 rpm. When the internal temperature of the flask reached 78° C., sodium hydroxide was added to the flask to adjust the pH of the flask contents to 7. Subsequently, the flask contents were cooled until the temperature thereof became normal temperature (approximately 25° C.) to obtain a dispersion containing first covered cores (toner cores each partly covered with a non-cross-linked resin film piece).

(Washing Process)

The dispersion of the first covered cores obtained as above was filtrated (solid-liquid separation) using a Buhner funnel to collect a wet cake of the first covered cores. Thereafter, the resultant wet cake of the first covered cores was re-dispersed in ion-exchanged water. Dispersion and filtration were repeated by additional five times to wash the first covered cores.

(Drying Process)

Next, the resultant first covered cores were dispersed in an ethanol solution at a concentration of 50% by mass. Through the above, a slurry of the first covered cores was obtained. Subsequently, the first covered cores in the slurry were dried under conditions of a hot air temperature of 45° C. and a flow rate of 2 $m^3$/min. using a continuous surface-modifying apparatus ("Coatmizer (registered Japanese trademark)" produced by Freund Corporation). As a result a powder of the first covered cores was obtained.

(Particle-Shaped Domain Formation Process)

Subsequently, 100 parts by mass of the first covered cores and 1.25 parts by mass of cross-linked resin particles (any of the resin powders B-1-B-4 listed in Table 1 for the respective toners) were mixed for one minute using a 10-L FM mixer (product of Nippon Coke & Engineering Co., Ltd.) to attach the cross-linked resin particles to the surfaces of the first covered cores. For example, the resin powder B-3 was used as the cross-linked resin particles in production of the toner T-1. As a result, toner mother particles were obtained. Note that the particle-shaped domain formation process was omitted in production of the toner T-7 in which no cross-linked resin particles were used.

(External Addition Process)

Next, 100 parts by mass of the toner mother particles, 1 part by mass of dry silica particles ("AEROSIL (registered Japanese trademark) REA90" produced by Nippon Aerosil Co., Ltd., content: dry silica particles to which positive chargeability was imparted by surface treatment, number average primary particle diameter: approximately 20 nm), and 0.5 parts by mass of conductive titanium oxide particles ("EC-100" produced by Titan Kogyo, Ltd., base: $TiO_2$ particles, coat layer: Sb-doped $SnO_2$ film, number average primary particle diameter: approximately 0.35 μm) were mixed for five minutes using a 10-L FM mixer (product of Nippon Coke & Engineering Co., Ltd.). Through the above mixing, an external additive is attached to the surfaces of the toner mother particles. Next, sifting was performed using a 200-mesh sieve (opening 75 μm). As a result, a toner containing multiple toner particles (any of the toner T-1-T11 listed in Table 1) was produced.

For each of the samples (toners T-1-T-11), the first and second surface adsorption forces were measured using a scanning probe microscope (SPM) and the first coverage ratio of the toner cores was measured using a transmission electron microscope (TEM). The measurement results are listed in Table 1. For example, the toner T-1 had a first surface adsorption force of 39.1 nN, a second surface adsorption force of 6.0 nN, and a first coverage ratio of 69%.

<Method for Measuring Surface Adsorption Force>

A measuring device used was an SPM scanning probe station ("NanoNaviReal" produced by Hitachi High-Tech Science Corporation) provided with a scanning probe microscope (SPM) ("Multi-function Unit AFM5200S" produced by Hitachi High-Tech Science Corporation). Prior to the measurement, average toner particles (toner particles each having moderate projections and recesses) were selected from among the toner particles included in the sample (toner) using a scanning electron microscope (SEM) ("JSM-6700F" produced by JEOL Ltd.) and the selected toner particles were determined to be a measurement target. A field of view (measurement part) was set so that a first shell part (part constituted by only a film-shaped domain) and a second shell part (part constituted only by a particle-shaped domain) are included within a measurement range.

(SPM Measurement Conditions)

Measurement probe: low-spring constant silicon cantilever ("OMCL-AC240TS-C3" produced by Olympus Corporation, spring constant: 2 N/m, resonance frequency: 70 kHz, back reflection coating material: aluminum).

Measurement mode: SIS-DFM (SIS: sampling intelligent scan mode, DFM: dynamic force mode).

Measurement range (per field of view): 1 μm×1 μm.

Resolution (X data/Y data): 256/256.

A measurement area (X-Y plane: 1 μm×1 μm) of the surface of the measurement target was scanned horizontally in the above measurement mode (SIS-DAM) using the cantilever in an environment at a temperature of 23° C. and a relative humidity of 60% for plotting an AFM force curve to obtain an image mapped for surface adsorption force. The AFM force curve is a curve indicating a relationship between force acting on the cantilever (deflection amount) and the distance between the probe (tip end of the cantilever) and the measurement target. The surface adsorption force of the measurement target (power necessary for the cantilever to separate from the surface of the measurement target) can be determined from the AFM force curve. Pressing force of the cantilever (deflection signal) was detected using an optical lever in the above measuring device. Specifically, a semiconductor laser device irradiates the back surface of the cantilever with a laser beam and a position sensor detects the laser beam (deflection signal) reflected on the back surface of the cantilever.

The surface adsorption force of the first shell parts (first surface adsorption force) and that of the second shell parts (second surface adsorption force) were determined based on the image mapped for the surface adsorption force obtained as above. Specifically, the surface adsorption force (first or second surface adsorption force) was measured at ten points of each of five toner particles included in the sample (toner) to obtain 50 measurement values for each sample (toner). The arithmetic means of the 50 measurement values was determined to be an evaluation value (first or second surface adsorption force) of the sample (toner).

<First Coverage Ratio Measuring Method>

The sample (toner) was embedded in a visible-light curable resin ("ARONIX (registered Japanese trademark) D-800" produced by Toagosei Co., Ltd.) to obtain a cured material. Thereafter, the cured material was sliced into a thin piece having a thickness of 150 nm at a slicing speed of 0.3 mm/sec. using a ultrathin piece slicing knife ("Sumi Knife (registered Japanese trademark)" produced by Sumitomo Electric Industries, Ltd., diamond knife having a blade width of 2 mm and a blade angel of 45°) and a ultramicrotome ("EM UC6" produced by Leica Microsystems GmbH). The sliced thin piece was placed on a copper mesh and Ru-dyed by being exposed in a steam of a ruthenium tetroxide solution for ten minutes. Subsequently, a cross section of the dyed thin sample piece was captured using a transmission electron microscope (TEM) ("JSM-6700F" produced by JEOL Ltd.). The captured TEM image (cross-sectional image of a toner particle) was analyzed using image analysis software ("WinROOF" produced by Mitani Corporation). Specifically, a ratio (first coverage ratio) of a total length of regions of a surface region of a toner core (contour line indicating outer rim) that are each covered with a film-shaped domain (total length of first and third covered regions) was measured on the TEM image (cross-sectional image of the toner particle). Specifically, the first coverage ratio (unit: %) of the toner core was calculated based on an equation "(first coverage ratio)=100×(length of first covered regions)+(length of third covered regions))/(peripheral length of toner core)". The first coverage ratio of the toner cores of ten toner particles included in each sample (toner) was calculated. The arithmetic mean of the calculated ten measurement values was determined to be an evaluation value (first coverage ratio of toner cores) of the sample (toner).

[Evaluation Methods]

Each of the samples (toners T-1 to T-11) were evaluated according to the following evaluation methods.

(Heat-Resistant Preservability)

A 20-mL polyethylene vessel to which 2 g of the sample (toner) had been added was allowed to stand for three hours in a thermostatic chamber set at 58° C. The toner was then taken out from the thermostatic chamber and cooled to room temperature to give an evaluation toner.

The resultant evaluation toner was subsequently placed on a 100-mesh sieve (opening: 150 μm) whose mass is known. The mass of the toner prior to sifting was calculated by measuring the total mass of the sieve and the toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. After the sifting, the mass of toner remaining on the sieve was calculated by measuring the total mass of the sieve and the toner thereon. The aggregation rate (unit: % by mass) of the toner was calculated from the mass of the toner prior to sifting and the mass of the toner after sifting (mass of the toner remaining on the sieve after sifting) based on the following expression.

(Aggregation rate)=100×(mass of toner after sifting)/(mass of toner prior to sifting)

An aggregation rate of no greater than 50% by mass was evaluated as good (Good) and an aggregation rate of greater than 50% by mass was evaluated as poor (Poor).

(Lowest Fixable Temperature)

A ball mill was used to mix 100 parts by mass of a developer carrier ("carrier for "TASKalfa5550ci" produced by KYOCERA Document Solutions Inc.) and 10 parts by mass of the sample (toner) for 30 minutes to prepare a two-component developer.

Evaluation of lowest fixable temperature was performed using an image formed with use of the two-component developer prepared as above. An evaluation device used was a color printer ("FS-C5250DN" produced by KYOCERA Document Solutions Inc., modified to enable adjustment of fixing temperature) having a roller-roller type heat-pressure fixing section. The two-component developer prepared as above was loaded into a developing device of the evaluation apparatus, and the sample (toner for replenishment use) was loaded into a toner container of the evaluation apparatus.

A solid image (specifically, non-fixed toner image) having a size of 25 mm by 25 mm was formed on a piece of paper having a basis weight of 90 g/m$^2$ (A4-size printing paper) in an environment at a temperature of 23° C. and a relative humidity of 60% under conditions of a linear velocity of 200 mm/sec. and a toner applied amount of 1.0 mg/cm$^2$. Next, the paper on which the image has been formed was passed through the fixing device of the evaluation apparatus.

The fixing temperature was set within a range from 100° C. to 200° C. in the lowest fixable temperature evaluation. Specifically, a minimum temperature at which the solid image (toner image) was fixable to the paper (i.e., lowest fixable temperature) was measured by increasing the fixing temperature of the fixing device from 100° C. in increments of 5° C. (wherein in increments of 2° C. in the vicinity of the lowest fixable temperature). The following fold-rubbing test was performed to confirm whether or not the toner was fixed. Specifically, the evaluation paper having passed through the fixing device was folded in half such that a surface on which the image has been formed was folded inwards, and a 1 kg weight covered with cloth was rubbed back and forth on the fold five times. Next, the paper was opened up and a fold portion (i.e., a portion in which the solid image was formed) was observed. The length of toner peeling in the fold portion (peeling length) was measured. A minimum temperature among temperatures for which the peeling length was no greater than 1 mm was determined to be a lowest fixable temperature. A lowest fixable temperature of no greater than 145° C. was evaluated as good (Good), and a lowest fixable temperature of greater than 145° C. was evaluated as poor (Poor).

(External Additive Hodling Ability)

External additive hodling ability of the sample (toner) was evaluated by measuring the amount of silica particles desorbed from the sample (toner) in a situation in which the sample was subjected to ultrasonication.

<Ultrasonication>

A 500-mL beaker was charged with 2 g of the sample (toner) and 40 mL of an aqueous solution of a nonionic surfactant ("EMULGEN (registered Japanese trademark) 120" produced by Kao Corporation, component: polyoxyethylene lauryl ether) at a concentration of 2% by mass in an environment at a temperature of 25° C. and a relative humidity of 50%. The beaker contents were then stirred using a spatula until the toner is dispersed in the solution to the extent that a lump of toner was not visibly found, thereby obtaining a dispersion. Subsequently, ultrasonic vibration was applied to the dispersion for five minutes using a ultrasonication apparatus ("Ultrasonic Generator" produced by ULTRASONIC ENGINEERING CO., LTD., high-frequency output: 100 W, oscillation frequency: 28 kHz). Thereafter, the dispersion subjected to the ultrasonication was transferred to a 50-mL vial. The vial content was then allowed to stand for 12 hours for toner precipitation. The Si content of a supernatant in the vial was then measured using a fluorescent X ray under the following conditions. Specifically, the intensity (unit: kcps) of a peak of a fluorescent X-ray attributive to Si in the supernatant was measured.

<Conditions for Fluorescent X-Ray Analysis>

Analyzer: scanning fluorescent X-ray analyzer ("ZSX" produced by Rigaku Corporation).

X-ray tube (X-ray source): Rh (rhodium).

Excitation condition: tube voltage of 50 kV, tube current of 50 mA.

Measurement area (X-ray irradiation area): diameter of 30 mm.

Measured element: Si (silicon).

An intensity of a peak of the fluorescent X-ray attributive to Si of no greater than 1.00 kcps was evaluated as good (Good), and that of greater than 1.00 kcps was evaluated as poor (Poor).

[Evaluation Results]

Table 2 indicates respective evaluation results for the toners T-1-T-11 (heat-resistant preservability: aggregation rate, low-temperature fixability: lowest fixable temperature, external additive hodling ability: peak intensity of fluorescent X-ray).

TABLE 2

| | Toner | Heat-resistant preservability [% by mass] | Low-temperature fixability [° C.] | External additive hodling ability [kcps] |
|---|---|---|---|---|
| Example 1 | T-1 | 19 | 130 | 0.65 |
| Example 2 | T-2 | 13 | 134 | 0.82 |
| Example 3 | T-3 | 12 | 142 | 0.94 |
| Example 4 | T-4 | 12 | 134 | 0.72 |
| Example 5 | T-5 | 27 | 126 | 0.62 |
| Example 6 | T-6 | 12 | 138 | 0.94 |
| Comparative Example 1 | T-7 | 61 (Poor) | 120 | 0.50 |
| Comparative Example 2 | T-8 | 9 | 146 (Poor) | 1.21 (Poor) |
| Comparative Example 3 | T-9 | 51 (Poor) | 128 | 0.63 |
| Comparative Example 4 | T-10 | 54 (Poor) | 122 | 0.66 |
| Comparative Example 5 | T-11 | 51 (Poor) | 120 | 0.65 |

Each of the toners T-1-T-6 (toners of Examples 1-6) had the aforementioned basic features. Specifically, each of the toners of Examples 1-6 included toner particles each including inorganic particles (silica particles and titanium oxide particles) as an external additive. The shell layer thereof included the film-shaped first domains and the particle-shaped second domains. The first domains were substantially formed from a non-cross-linked resin (specifically, non-cross-linked styrene-acrylic acid-based resin). The second domains were substantially formed from a cross-linked resin (specifically, cross-linked acrylic acid-based resin). Furthermore, the cross-linked resin had a glass transition point (Tg) higher by 40° C. or more than that of the non-cross-linked resin (see Table 1). For example, the toner T-1 contained a non-cross-linked resin having a Tg of 68° C. and a cross-linked resin having a Tg of 130° C., wherefore the Tg difference (=(Tg of cross-linked resin)−(Tg of non-cross-linked resin)) was 62° C. Furthermore, the first domains had a surface adsorption force (first surface adsorption force) of at least 20.0 nN and no greater than 40.0 nN and the second domains had a surface adsorption force (second surface adsorption force) of at least 4.0 nN and less than 20.0 nN (see Table 1). For example, the toner T-1 had a first surface adsorption force of 39.1 nN and a second surface adsorption force of 6.0 nN. The toners T-1-T-6 each were excellent in heat-resistant preservability, low-temperature fixability, and external additive hodling ability as indicated in Table 2. Note that the toners T-1-T-6 each had a first coverage ratio of at least 40% and no greater than 80% (see Table 1). The respective second coverage ratios measured by a method following the method adopted to the first coverage ratio (specifically, image analysis of cross-sectional image of toner particle) were at least 70% and no greater than 99%. The total length of the second covered regions was larger than the total length of the third covered regions in the cross-sectional image of the toner particles.

The toner T-7 (toner of Comparative Example 1) was inferior in heat-resistant preservability to the toners T-1-T-6. An exposed area of the toner cores in the toner T-7, which used no cross-linked resin particles, was large with a result that toner particles readily agglomerated together.

The toner T-8 (toner of Comparative Example 2) was inferior in external additive hodling ability to the toners T-1-T-6. The cause therefor is thought to be a too small first surface adsorption force (see Table 1).

The toner T-9 (toner of Comparative Example 3) was inferior in heat-resistant preservability to the toners T-1-T-6. The cause therefor is thought to be a too large first surface adsorption force (see Table 1).

The toner T-10 (toner of Comparative Example 4) was inferior in heat-resistant preservability to the toners T-1-T-6. The cause therefor is thought to be a too large second surface adsorption force (see Table 1).

The toner T-11 (toner of Comparative Example 5) was inferior in heat-resistant preservability to the toners T-1-T-6. The cause therefor is thought to be a too small Tg difference (=(Tg of cross-linked resin)−(Tg of non-cross-linked resin)) (see Table 1).

INDUSTRIAL APPLICABILITY

The electrostatic latent image developing toner according to the present invention can be used in image formation for example using a copier, a printer, or a multifunction peripheral.

The invention claimed is:

1. An electrostatic latent image developing toner comprising a plurality of toner particles each including a toner mother particle and inorganic particles attached to a surface of the toner mother particle, wherein the toner mother particle includes a core and a shell layer covering a surface of the core, the shell layer includes film-shaped first domains and particle-shaped second domains, the first domains are substantially formed from a non-cross-linked resin while the second domains are substantially formed from a cross-linked resin, the cross-linked resin has a glass transition point higher by 40° C. or more than that of the non-cross-linked resin, the shell layer includes first shell parts constituted by only the first domains, second shell parts constituted by only the second domains, and third shell parts in which one of the first domains and one of the second domains are layered in stated order from a side of the core, and does not include a part in which one of the second domains and one of the first domains are layered in stated order from the side of the core, the first domains have a surface adsorption force of at least 20.0 nN and no greater than 40.0 nN, and the second domains have a surface adsorption force of at least 4.0 nN and less than 20.0 nN.

2. The electrostatic latent image developing toner according to claim 1, wherein a ratio of a total length of regions of an entire surface region of the core that are covered with either of the first shell parts or the third shell parts is at least 40% and no greater than 80% relative to a peripheral length of the core.

3. The electrostatic latent image developing toner according to claim 2, wherein the surface region of the core includes first covered regions covered with the respective first shell parts, second covered regions covered with the respective second shell parts, and third covered region covered with the respective third shell parts, and a total length of the second covered regions is larger than that of the third covered regions in a cross-sectional image of the toner particle.

4. The electrostatic latent image developing toner according to claim 3, wherein a ratio of a total length of regions of the entire surface region of the core that are covered with any of the first to third shell parts is at least 70% and no greater than 99% relative to the peripheral length of the core.

5. The electrostatic latent image developing toner according to claim 1, wherein the first and second domains have the same polarity, and the first and second domains each have a polarity opposite to that of the core.

6. The electrostatic latent image developing toner according to claim 1, wherein the cross-linked resin is a cross-linked acrylic acid-based resin, and the non-cross-linked resin is a non-cross-linked styrene-acrylic acid-based resin.

7. The electrostatic latent image developing toner according to claim 6, wherein the cross-linked acrylic acid-based resin is a polymer of monomers including at least one (meth)acrylic acid ester and at least one (meth)acrylic acid ester of alkylene glycol, and the non-cross-linked styrene-acrylic acid-based resin is a polymer of monomers including at least one styrene-based monomer, at least one (meth)acrylic acid ester, and at least one (meth)acrylic acid hydroxyalkyl ester.

8. The electrostatic latent image developing toner according to claim 6, wherein the core has a lower glass transition point than the non-cross-linked resin.

9. The electrostatic latent image developing toner according to claim 8, wherein the core contains a crystalline polyester resin and a non-crystalline polyester resin.

10. The electrostatic latent image developing toner according to claim 9, wherein the core is a pulverized core.

* * * * *